US007148626B2

(12) United States Patent
Fran et al.

(10) Patent No.: US 7,148,626 B2
(45) Date of Patent: Dec. 12, 2006

(54) FLAT LAMP STRUCTURE WITH ELECTRODES DISPOSED ON OUTER SURFACE OF THE SUBSTRATE

(75) Inventors: Yui-Shin Fran, Hsinchu (TW); Lai-Cheng Chen, Hsinchu (TW); Cheng-Yi Chang, Hsinchu (TW); Chien-Chung Wu, Taipei (TW); Jui-Hsia Chen, Yunlin Hsien (TW); Jer-Shien Yang, Chia-Yi Hsien (TW)

(73) Assignee: Delta Optoelectronics, Inc., Hsinchu (TW)

( * ) Notice: Subject to any disclaimer, the term of this patent is extended or adjusted under 35 U.S.C. 154(b) by 107 days.

(21) Appl. No.: 10/604,588

(22) Filed: Jul. 31, 2003

(65) Prior Publication Data

US 2004/0119411 A1 Jun. 24, 2004

(30) Foreign Application Priority Data

Dec. 24, 2002 (TW) ..... 91137109 A

(51) Int. Cl.
*H01J 1/62* (2006.01)

(52) U.S. Cl. ..... 313/607; 313/484; 313/493; 313/594; 313/234

(58) Field of Classification Search ..... 313/491, 313/493, 494, 607, 234, 594; 362/26, 31
See application file for complete search history.

(56) References Cited

U.S. PATENT DOCUMENTS

| | | | | |
|---|---|---|---|---|
| 4,851,734 | A * | 7/1989 | Hamai et al. | 313/485 |
| 4,983,881 | A | 1/1991 | Eliasson et al. | 313/607 |
| 5,319,282 | A * | 6/1994 | Winsor | 315/169.4 |
| 5,565,733 | A * | 10/1996 | Krafcik et al. | 313/510 |
| 5,592,047 | A * | 1/1997 | Park et al. | 313/484 |
| 6,034,470 | A * | 3/2000 | Vollkommer et al. | 313/485 |
| 6,255,782 | B1 * | 7/2001 | Kuroda et al. | 315/169.1 |
| 6,744,195 | B1 * | 6/2004 | Park | 313/491 |
| 6,762,556 | B1 * | 7/2004 | Winsor | 313/607 |
| 2002/0117959 | A1 | 8/2002 | Winsor | 313/484 |

FOREIGN PATENT DOCUMENTS

| | | |
|---|---|---|
| EP | 0 521 553 A2 | 1/1993 |
| FR | 2 843 483 A1 | 2/2004 |
| WO | WO 2004/015739 A2 | 2/2004 |

OTHER PUBLICATIONS

Mikoshiba S ED—Society for Information Display: "Invited Paper: Xc Discharge Backlights for LCDs" 2001 SID International Symposium Digest of Technical Papers. San Jose, CA, Jun. 5-7, 2001, SID International Symposium Digest of Technical Papers, San Jose, CA : SID, US, vol. 32. Jun. 2001, pp. 286-289, XP 001054087.

* cited by examiner

*Primary Examiner*—Sikha Roy
(74) *Attorney, Agent, or Firm*—Jianq Chyun IP Office

(57) ABSTRACT

A flat lamp structure is disclosed. The flat lamp structure includes a gas discharge chamber, a fluorescence substance, a discharge gas, and a plurality of electrodes. The fluorescence substance is disposed on the inner wall of the gas discharge chamber, and the discharge gas is disposed in the gas discharge chamber. The electrodes are disposed on the outer wall of the gas discharge chamber, wherein the gas discharge chamber comprises a dielectric substrate, a plate, and a plurality of rods, and the plate is disposed on the upper portion of the dielectric substrate and the rods are disposed between the plate and the dielectric substrate, and the plate and the edge of dielectric are connected. Additionally, the gas discharge chamber, for example, can dispose with at least a spacer to enhance the strength of the gas discharge chamber.

9 Claims, 2 Drawing Sheets

FLAT LAMP STRUCTURE WITH ELECTRODES DISPOSED ON OUTER SURFACE OF THE SUBSTRATE

CROSS REFERENCE TO RELATED APPLICATIONS

This application claims the priority benefit of Taiwan application serial no. 91137109, filed on Dec. 24, 2002.

BACKGROUND OF INVENTION

1. Field of the Invention

The present invention relates to a flat lamp structure, and in particular, to a flat lamp structure having electrodes positioned on the outer wall of a gas discharge chamber.

2. Description of the Related Art

As a consequence of industrial progress, developments in mobile phones, digital cameras, digital video cameras, notebook computers, and desk-top computers are now concerned with multifunctional and aesthetic design. However, the display screen used in mobile phones, digital cameras, digital video cameras, notebook computers, and desk-top computers is an essential interactive interface. The display screen provides the user with great convenience of operation. In recent years, it has become commonplace for most mobile phones, digital cameras, digital video cameras, notebook computers, and desk-top computers to employ a LCD panel as the display screen. However, the LCD panel per se is non-luminous, and a back light module must be provided at the bottom of the LCD panel to provide a light source for displaying.

The flat lamp provides excellent luminosity and uniformity and also provides a larger surface area light source. Therefore, it is widely applied as a back light source for LCD panels and for other fields of applications. The flat lamp is a plasma luminous component, essentially utilizing the electrons emitted from the cathode to collide with the inert gas between the cathode and anode within the gas discharge chamber, and the gas is ionized and excited to form plasma. After that the excited state atoms of the plasma return to the ground state by emission of UV rays, the UV rays further excite the fluorescence substance within the flat lamp, producing visible light.

FIG. 1 is a schematic view showing the structure of a conventional flat lamp.

Referring to FIG. 1, the conventional flat lamp structure comprises a gas discharge chamber 100, a fluorescence substance 102, a discharge gas 104, electrodes 106 and dielectric layers 108. The gas discharge chamber 100 comprises a plate 100*a*, a second plate 100*b* and strip 100*c* mounted between the plate 100*a* and the plate 100*b*, and is connected to the edge of the plate 100*a* and the edge of plate 100*b*, forming a closed chamber.

Referring again to FIG. 1, the conventional electrode 106 is generally a silver electrode, and the electrode 106 is disposed on the plate 100*a*. The electrode is generally covered with the dielectric layer 108 so as to protect the electrode 106 from damaging by the collision of the ions. As shown in FIG. 1, the dielectric layer 108 covering electrode 106 is positioned at the inner wall of the gas discharge chamber 100. The gas discharge chamber 100 is charged with a gas 104. Generally, the gas 104 includes Xe, Ne and Ar, or other inert gas. Moreover, the fluorescence substance 102 is disposed on the inner wall of the gas discharge chamber 100, for example on the surface of the plate 100*b*, on the surface of the dielectric layer 108, and on the surface of the plate 100*a* not covered by the dielectric layer 108.

In the process of ignition of the flat lamp, the electrode 106 emits electrons to collide with the discharge gas 104 within the gas discharge chamber 100, and the discharge gas 104 is ionized and excited to form plasma. After that, the excited state atoms of the plasma return to the ground state by emitting UV rays, and the emitted UV rays further excite the fluorescence substance 102 within the inner wall of the gas discharge chamber 100 to produce visible light. However, on the above light luminous mechanism, the high energy ions released by the plasma generally collide through the dielectric layer, and may reach further to the electrode 106. Thus, the longevity of the flat lamp is greatly reduced.

Please note that the dielectric layer 108 covering the electrode 106 is generally fabricated by a multiple screen printing process the thickness of which is controlled between 200 μm to 250 μm. However, the fabrication process of the multiple screen printing is complicated, and the test sample capacity and yield are low. In addition, multiple screen printing can easily cause unevenness in the thickness of the film, causing each of the test samples or a single test sample with different optical characteristics of different region to differ with each other. Due to the fact that the optical characteristics of the test sample cannot be easily controlled, the designing cost for the driving circuit is increased.

SUMMARY OF INVENTION

Accordingly, it is an object of the present invention to provide a flat lamp structure which effectively avoids collision through the dielectric layer, improving the longevity of the flat lamp.

Another object of the present invention is to provide a flat lamp structure which effectively avoids the unevenness occurring on the dielectric substrate film due to multiple screen printing, thereby improving the luminosity and the uniformity of the flat lamp.

In order to achieve the above objects, the present invention provides a flat lamp structure comprising a gas discharge chamber; a fluorescence substance disposed on the inner wall of the gas discharge chamber; a discharge gas disposed in the gas discharge chamber; and a plurality of electrodes disposed on the outer wall of the gas discharge chamber.

The gas discharge chamber, for example, comprises a dielectric substrate; a plate disposed on the upper portion of the dielectric substrate; and a plurality of strips disposed between the dielectric substrate and the plate, and the plate connected to the edge of the dielectric substrate.

In order to achieve the above objects, the present invention provides a flat lamp structure comprising a gas discharge chamber; a fluorescence substance disposed on the inner wall of the gas discharge chamber; a discharge gas disposed in the gas discharge chamber; a plurality of electrodes disposed on the outer wall of the gas discharge chamber; and a spacer disposed on the gas discharge chamber to enhance the strength of the gas discharge chamber.

The gas discharge chamber, for example, comprises a dielectric substrate; a plate disposed on the upper portion of the dielectric substrate; and a plurality of strips disposed between the dielectric substrate and the plate, and plate connected to the edge of the dielectric substrate.

In accordance with a preferred embodiment of the present invention, the thickness of the dielectric substrate is, for example, between 0.3 mm and 1.1 mm, and the distance between the dielectric substrate and the plate, for example, is between 0.5 mm and 2.0 mm.

In accordance with the preferred embodiment of the present invention, the gas charged into the gas discharge chamber, for example, is Xe, Ne or Ar, and the electrodes, for example, include silver electrode or copper electrode.

In accordance with the preferred embodiment of the present invention, the lower portion of the dielectric substrate, for example, is stuck to a carrier substrate for carrying the gas discharge chamber containing the electrode.

In addition, an adhesive, for example, is disposed between the dielectric substrate and the carrier substrate and connects the dielectric substrate and the carrier substrate.

In accordance with the preferred embodiment of the present invention, the adhesive, for example, includes glass adhesive, UV curing adhesive or thermal curing adhesive.

In accordance with the present invention, the electrode is fabricated on the outer wall of the gas discharge chamber, and by means of the dielectric substrate as dielectric material for protecting the electrode, the uniformity with respect to thickness is good and the ability to withstand the collision of ions is excellent. Thus, the present invention does not require a dielectric layer formed by multiple screen printing covering the electrode, resulting in uniformity of luminosity and significant improvement in longevity.

BRIEF DESCRIPTION OF DRAWINGS

The accompanying drawings are included to provide a further understanding of the invention, and are incorporated in and constitute a part of this specification. The drawings illustrate embodiments of the invention and, together with the description, serve the principles of the invention.

DETAILED DESCRIPTION

Figure 1:
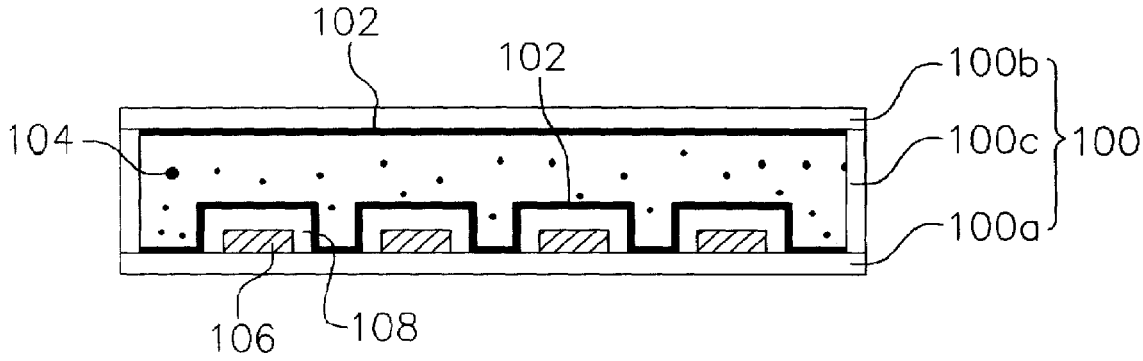
FIG. 1 (PRIOR ART)
FIG. 1 is a schematic view of a conventional flat lamp structure.

Reference will now be made in detail to the present preferred embodiments of the invention, examples of which are illustrated in the accompanying drawings. Wherever possible, the same reference numbers are used in the drawings and the description to refer to the same or like parts.

Figure 2:
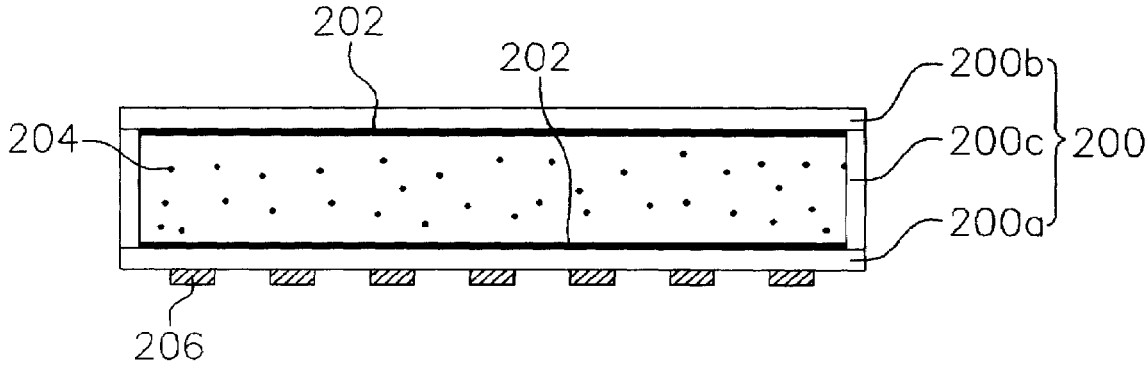
FIGS. 2 and 3 are schematic views of a first preferred embodiment flat lamp in accordance with the present invention.
Figure 3:
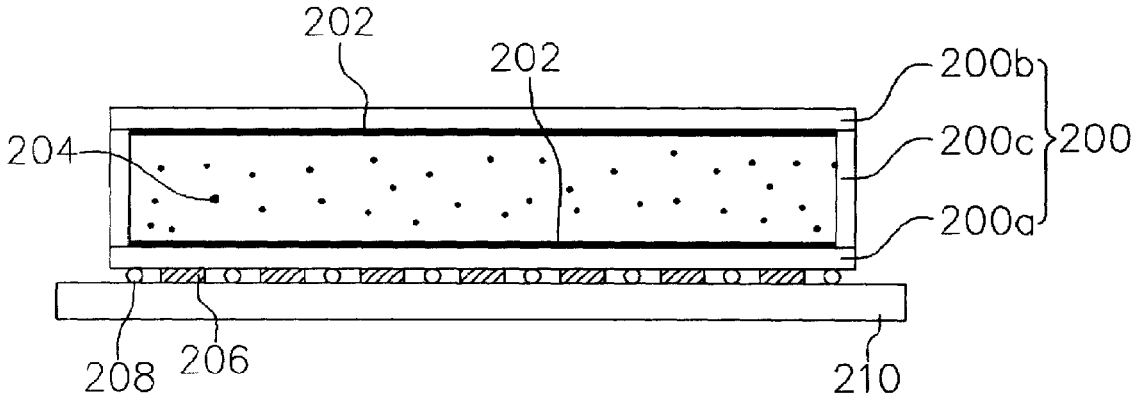

FIGS. 2 and 3 show schematically the flat lamp structure of a first preferred embodiment of the present invention.

First, referring to FIG. 2, the flat lamp comprises a gas discharge chamber 200, fluorescence substance 202, a discharge gas 204 and a plurality of electrodes 206. Wherein the material for forming the gas discharge chamber is, for example, glass. The gas discharge chamber 200, for instance, is a dielectric substrate 200*a*, a plate 200*b* and a plurality of strips 200*c*. The plate 200*b* is disposed on the upper portion of the dielectric substrate 200*a*, and the strips 200*c* are disposed between the dielectric substrate 200*a* and the plate 200*b*, and are connected to the dielectric substrate 200*a* and the edge of the plate 200*b*. In the present preferred embodiment, the thickness of the dielectric substrate is, for example, between 0.3 mm to 1.1 mm, and the distance between the dielectric substrate 200*a* and the plate 200*b* is, for example, between 0.5 mm and 2.0 mm.

Similarly, referring to FIG. 2, the fluorescence substance 202 is disposed on the inner wall of the gas discharged chamber 200, and the fluorescence substance 202 is generally disposed on the dielectric substrate 200*a* and the surface of the plate 200*b*. The gas 204 is charged into the gas discharge chamber 200, and examples of the gas are Xe, Ne, and Ar. The electrode 206 is disposed on the outer wall of the gas discharge chamber 200. Examples of the electrodes are silver electrode or copper electrode.

In the process of ignition of the flat lamp, the electrode 206 on the outer wall of the gas discharge chamber 200 is driven so that the electrode within the gas discharge chamber 202 partially emits electrons which collide with the gas 204, and the gas 204 is ionized and excited to form plasma. After that, the excited state atoms of the plasma return to the ground state by way of emission of UV rays, and the emitted UV rays further excite the fluorescence substance 202 on the inner wall of the gas discharge chamber 200 so as to produce visible light.

In accordance with the preferred embodiment during the driving process, the electrodes 206, isolated by the dielectric substrate 200*a*, form an electric field within the gas discharge chamber 200, and the thickness of the dielectric substrate 200*a* directly affects the difficulty of the driving process. When the thickness of the dielectric substrate 200*a* is large, the flat lamp is more difficult to drive, and vice versa; to facilitate the driving process, a thinner dielectric material 200*a* is used. In contrast, the dielectric substrate 200*a* may be broken for the reason that the substrate 200*a* cannot withstand the external atmospheric pressure. Thus, in order to consider both the difficulty of the driving process and the strength of the dielectric substrate 200*a*, the present preferred embodiment provides a flat lamp structure, as shown in FIG. 3.

Referring to FIG. 3, in order to obtain a balance between the difficulty of the driving process and the strength of the dielectric substrate 200*a*, the present flat lamp structure, as shown in FIG. 2, is supported on a carrier substrate 210, and the dielectric substrate 200*a* and the carrier substrate 210 are connected, for example, by means of an adhesive 208 or a plurality of adhesive means of 208 having a thickness between 0.1 mm and 0.3 mm. In accordance with the present invention, the adhesive 208 includes, for example, glass adhesive, UV curing adhesive or thermal curing adhesive.

In accordance with the flat lamp structure, as the dielectric substrate 200*a* and the carrier substrate 210 are connected using the adhesive 208, the structural body constructed by the dielectric substrate 200*a* and the carrier substrate 210 can withstand the external atmospheric pressure, thus, as a whole, the strength of the flat lamp is enhanced.

Figure 4:
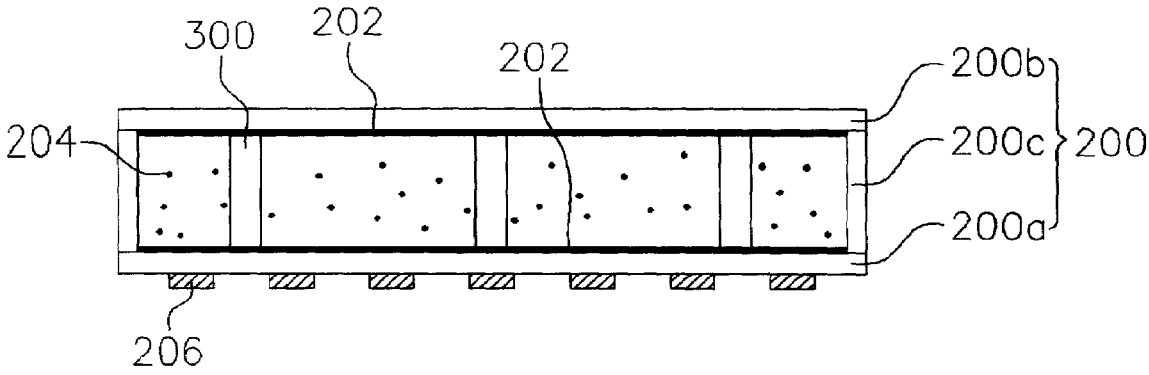
FIGS. 4 and 5 are schematic views of a second preferred embodiment flat lamp in accordance with the present invention.
Figure 5:
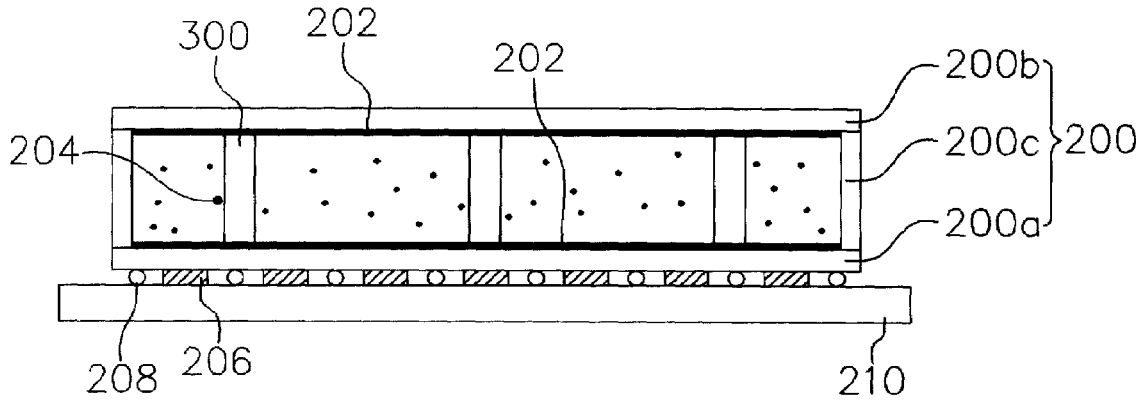

FIGS. 4 and 5 show a flat lamp structure in accordance with the second preferred embodiment. As shown in FIG. 4, the flat lamp comprises a gas discharge chamber 200, a fluorescence substance 202, a discharge gas 204, a plurality of electrodes 206 and at least a spacer 300, wherein the material of the gas discharge chamber 200 is, for example, glass. The gas discharge chamber 200 comprises a dielectric substrate 200*a*, a plate 200*b* and a plurality of strips 200*c*. The plate substrate 200*b* is disposed on the upper portion of the dielectric substrate 200*a*, and the strips 200*c* are disposed between the dielectric substrate 200*a* and the plate 200*b*, and the dielectric substrate 200*a* and the edge of the plate 200*b* are connected. In accordance with the preferred embodiment, the thickness of the dielectric substrate 200*a* is, for example, between 0.3 mm and 1.1 mm, and the distance between the dielectric substrate 200*a* and the plate 200*b* is, for example, between 0.5 mm and 2.0 mm.

Similarly, referring to FIG. 4, the fluorescence substance 202 is disposed on the inner wall of the gas disposed chamber 200, and the fluorescence substance 202 is generally disposed on the dielectric substrate 200*a* and the surface of the plate 200*b*. The gas 204 is charged into the gas discharge chamber 200, and an example of the gas is Xe. The electrode 206 is disposed on the outer wall of the gas discharge chamber 200. An example of the electrode is silver electrode.

The flat lamp structure of the present invention is similar to that of the first preferred embodiment, and the only difference is on the design of the spacer 300.

The spacer 300 is designed out of concern for the difficulty of the driving process and the strength of the dielectric substrate 200*a;* the spacer 300 of the gas discharge chamber 200*b* can withstand the dielectric substrate 200*a* and the surface of the plate 200*b* such that the strength of the dielectric substrate 200*a* can be enhanced, and its breakage as a result of its inability to withstand the external atmospheric pressure will not occur.

Next, referring to FIG. 5, there is shown the flat lamp structure similar to that shown in FIG. 3, the only difference is on the design of the spacer 300. In accordance with the present preferred embodiment, the dual reinforcement of the spacer 300 with the combination of the carrier 210 deals with the difficulty of the driving process and the strength of the dielectric substrate 200*a*.

In accordance with the present invention, the dielectric substrate with controllable thickness and uniformity is used to substitute conventional dielectric layer formed from multiple screen printing process and the electrode is disposed on the outer wall of the gas discharge chamber to form external electrodes. Thus, the flat lamp structure of the present invention possesses the following advantages: (1) The replacement of the dielectric layer fabricated by multiple screen printing with the present dielectric substrate provides a simple fabrication process and the fabrication time is shortened, and the yield is improved. (2) The replacement of the dielectric layer fabricated by multiple screen printing with the present dielectric substrate alleviates the error in the fabrication process, thus improving yield and reducing production costs. (3) Excellent thickness uniformity of the dielectric substrate allows for a small difference of electric field between the individual electrodes, thus the uniformity of light emission of the flat lamp is improved.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

The invention claimed is:

1. A flat lamp structure comprising:

a gas discharge chamber, wherein the gas discharge chamber comprises a dielectric substrate, a plate disposed above the dielectric substrate and a plurality of strips connecting edges of the dielectric substrate and the plate;

a fluorescence substance disposed on an inner wall of the gas discharge chamber;

a discharge gas disposed in the gas discharge chamber;

a plurality of electrodes disposed directly on an outer surface of an outer wall of the dielectric substrate of the gas discharge chamber and disposed only on the same surface of the dielectric substrate; and a carrier substrate disposed beneath the dielectric substrate to carry the gas discharge chamber, wherein a plurality of adhesive layers is disposed between the electrodes along the outer surface of the outer wall of the dielectric substrate to connect with the carrier substrate.

2. The flat lamp structure of claim 1, wherein a thickness of the dielectric substrate is between 0.3 mm and 1.1 mm.

3. The flat lamp structure of claim 1, wherein the distance between the dielectric substrate and the plate is between 0.5 mm and 2.0 mm.

4. The flat lamp structure of claim 1, wherein the discharge gas is an inert gas.

5. The flat lamp structure of claim 4, wherein the inert gas includes one of Xe, Ne or Ar.

6. The flat lamp structure of claim 1, wherein the electrode is a metal electrode.

7. The flat lamp structure of claim 6, wherein the metal electrode includes one of silver electrode or copper electrode.

8. The flat lamp structure of claim 1, wherein the adhesive includes one of glass adhesive, UV curing adhesive or thermal curing adhesive.

9. The flat lamp structure of claim 1, wherein the gas discharge chamber further comprises at least a spacer that extends from the dielectric substrate to the plate.

* * * * *